US006634746B2

(12) United States Patent
Kawakami

(10) Patent No.: US 6,634,746 B2
(45) Date of Patent: Oct. 21, 2003

(54) RECORDING APPARATUS

(75) Inventor: Kazuhisa Kawakami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/789,614

(22) Filed: Feb. 22, 2001

(65) Prior Publication Data

US 2001/0019349 A1 Sep. 6, 2001

(30) Foreign Application Priority Data

Mar. 2, 2000 (JP) ..... 2000-057091

(51) Int. Cl.[7] ..... B41J 29/13
(52) U.S. Cl. ..... 347/108; 347/37; 347/49
(58) Field of Search ..... 347/104, 108, 347/37, 49, 86, 87

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,333 A | | 12/1985 | Sugitani et al. | |
| 4,608,577 A | | 8/1986 | Hori | |
| 4,723,129 A | | 2/1988 | Endo et al. | |
| 4,740,796 A | | 4/1988 | Endo et al. | |
| 5,020,926 A | * | 6/1991 | Wilhelm | 400/54 |
| 5,461,408 A | * | 10/1995 | Giles et al. | 347/102 |
| 5,909,226 A | * | 6/1999 | Takeda | 347/3 |
| 6,296,345 B1 | * | 10/2001 | Kline et al. | 347/49 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |

* cited by examiner

*Primary Examiner*—Judy Nguyen
*Assistant Examiner*—Ly T Tran
(74) *Attorney, Agent, or Firm*—Fitzpatrick, Cella, Harper & Scinto

(57) ABSTRACT

A recording apparatus includes a carriage for carrying a recording head, a sheet-feeding cassette for holding recording sheets to be recorded, a sheet-discharging cassette for holding recording sheets after recording, and a mounting-and-detaching part for mounting and detaching the recording head to and from the carriage. Loading of the recording sheets to be recorded into the sheet-feeding cassette, unloading of the recording sheets after recording from the sheet-discharging cassette, and mounting and detaching of the recording head to and from the carriage can be performed at a front part of the recording apparatus.

32 Claims, 11 Drawing Sheets

RECORDING APPARATUS

BACKGROUND OF THE INVENTION

1. Field of the Invention

The present invention relates to recording apparatuses for recoding on media. In particular, the present invention relates to a recording apparatus to be used in an information processing unit, such as a printer, a copying machine, a word processor, or a computer.

2. Description of the Related Art

Hitherto, ink-jet recording apparatuses have become common and widely used for various applications. Generally, in an ink-jet recording apparatus, recording media are inserted downwardly at the back surface of a recording unit, the recording unit records on the media, and the recording media after recording are discharged toward the front of the recording unit. When a recording head and an ink tank mounted on a carriage are replaced, a lid covering an upper part of the recording unit must be moved upwardly to open the recording unit.

In another type of ink-jet recording apparatus, the recording media are inserted from the front of the recording unit, the media are inverted by a media inverting unit provided at the rear of the recording unit, and the recording media after recording are discharged toward the front of the recording apparatus. In this type of the ink jet recording apparatus, the lid covering the upper part of the recording unit must also be moved upwardly to open the recording unit when the recording head and the ink tank mounted on the carriage are replaced.

However, since a space for transferring the media from insertion and recording to discharge after recording, and a space above the recording apparatus for removing the lid when the recording head and the ink tank mounted on the carriage are replaced are required in the known ink-jet recording apparatuses, there is a problem in that quite a lot of space is necessary other than the space required for a main body of the recording apparatus.

SUMMARY OF THE INVENTION

Accordingly, it is an object of the present invention to provide a recording apparatus in which the space required when the recording apparatus is used is reduced without impairing the function of the recording apparatus.

It is another object of the present invention to provide a recording apparatus in which the space required for transferring media from insertion and recording to discharge after recording and the space above the recording apparatus required for raising a lid when a recording head and an ink tank mounted on a carriage are replaced, are also reduced.

Further objects, features and advantages of the present invention will become apparent from the following description of the preferred embodiments with reference to the attached drawings.

DESCRIPTION OF THE PREFERRED EMBODIMENTS

Embodiments according to the present invention are described below with reference to the drawings.

(First Embodiment)

Figure 1:
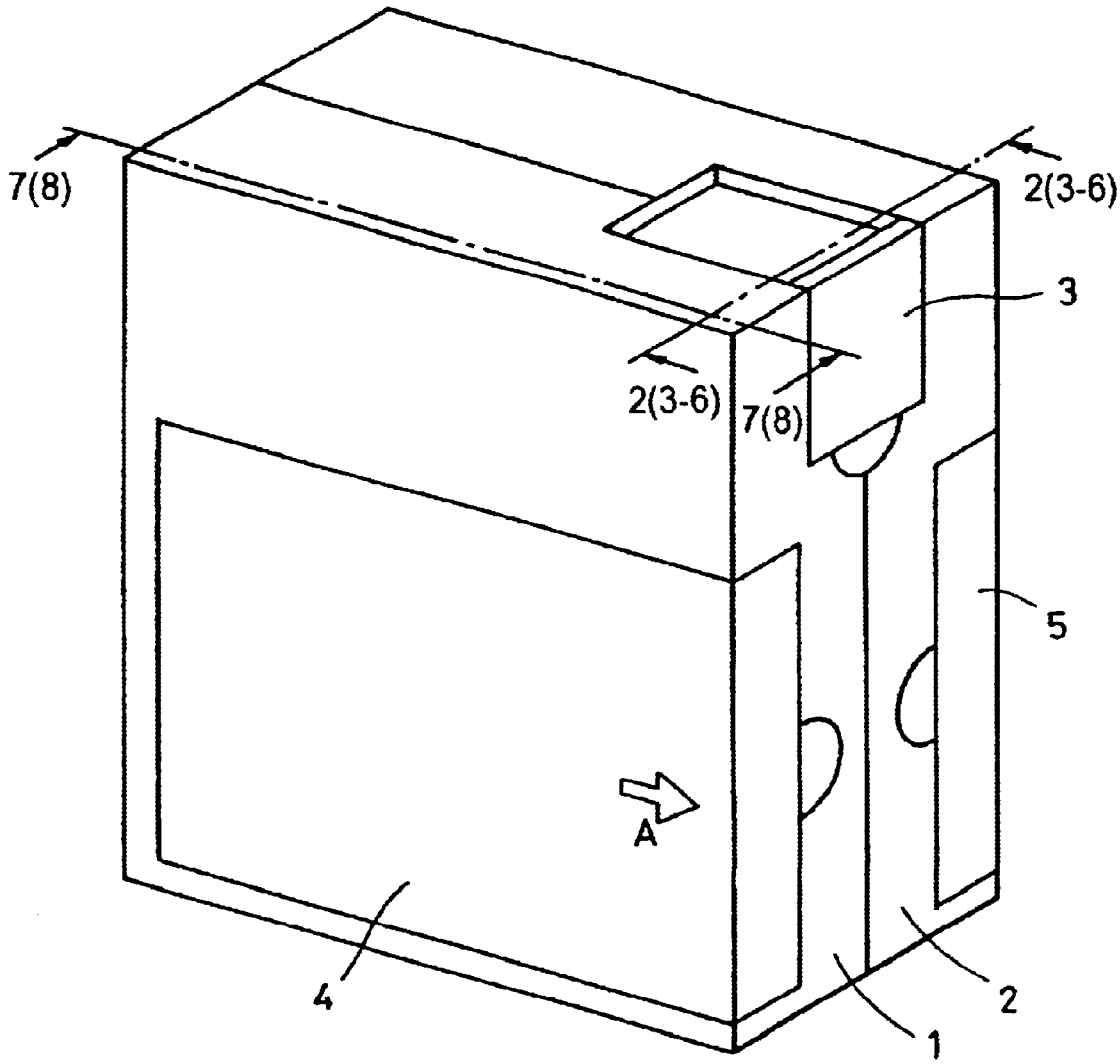
FIG. 1 is a perspective view of a recording apparatus according to a first embodiment of the present invention.
Figure 7:
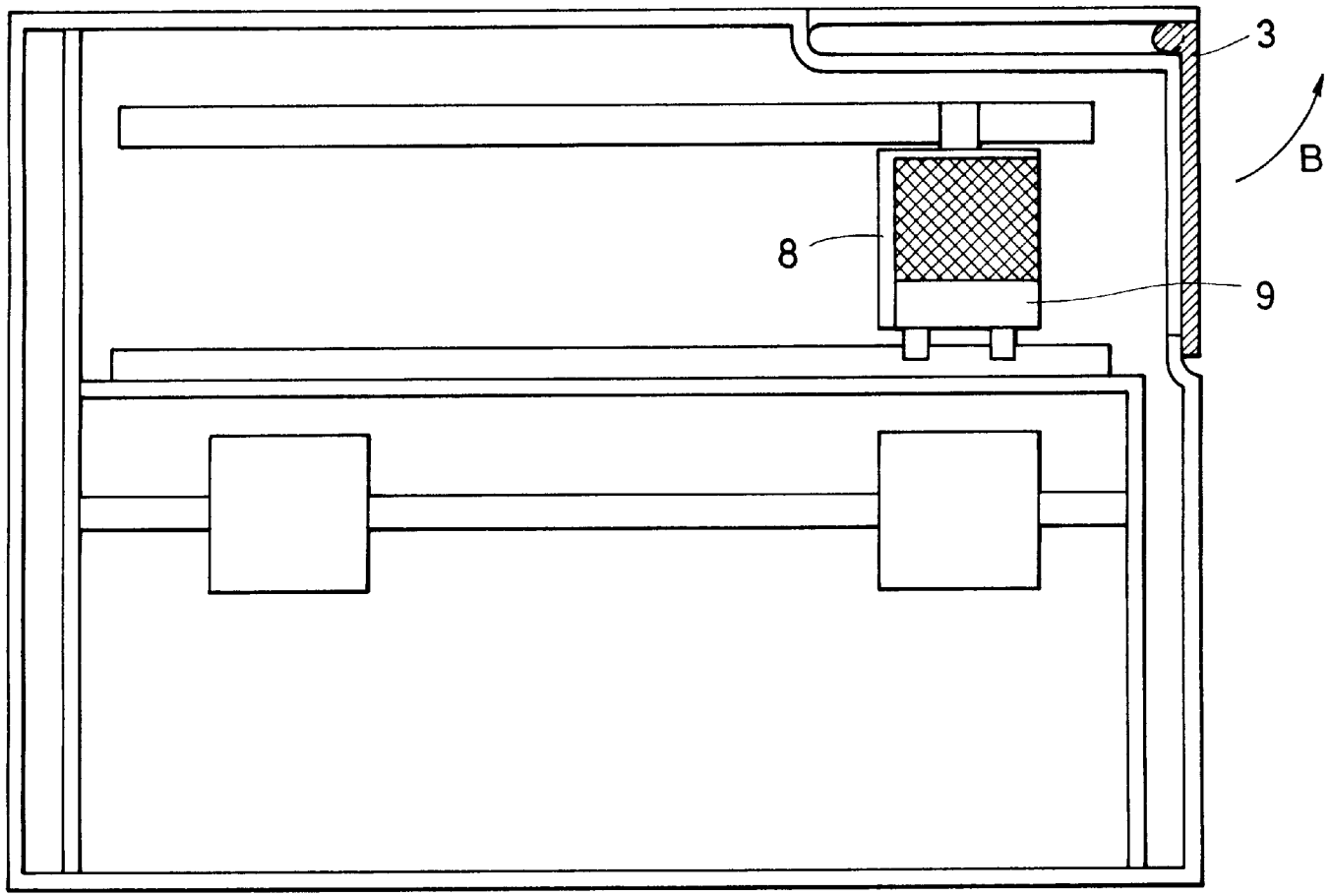
FIG. 7 is a sectional view of the recording apparatus shown in FIG. 1 along line 7(8)—7(8)
Figure 8:
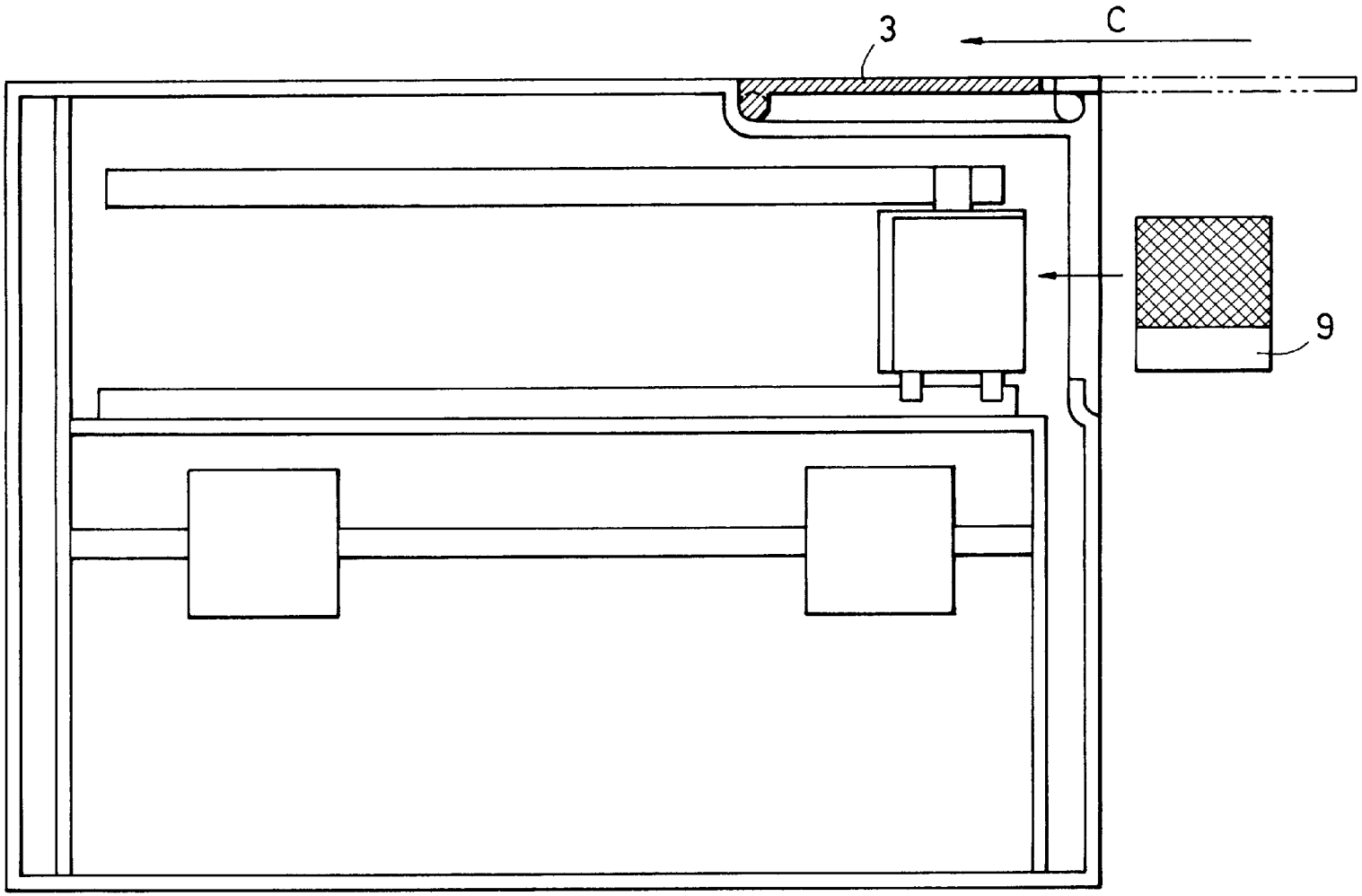
FIG. 8 is a sectional view of the recording apparatus shown in FIG. 1 along line 7(8)—7(8)

A first embodiment according to the present invention is described below with reference to FIGS. 1 to 8. FIG. 1 is a perspective view of a recording apparatus. FIGS. 2 to 6 are sectional views, along line 2(3-6)—2(3-6), of the recording apparatus shown in FIG. 1, showing the operation of the recording apparatus. FIGS. 7 and 8 are sectional views, along line 7(8)—7(8), of the recording apparatus shown in FIG. 1.

In FIG. 1, the recording apparatus includes a first main-body case 1, a second main-body case 2, a lid 3 capable of being removed or opened and closed for mounting and detaching a recording head, a sheet-feeding cassette 4 for holding recording sheets 6 which are recording media, and a sheet-discharging cassette 5 for holding the recording sheets 6 recorded thereon by a recording unit. The sheet feeding cassette 4 operates as a first holding member for holding the recording sheets 6 to be recorded. The sheet discharging cassette 5 operates as a second holding member for holding the recording sheets 6 after recording. The sheet-feeding cassette 4 and the sheet-discharging cassette 5 can be removed from the recording apparatus in a direction A shown in FIG. 1. When removed, the recording sheets 6 to be recorded can be loaded in the sheet-feeding cassette 4 and the recording sheets 6 after recording can be unloaded from the sheet-discharging cassette 5, respectively, at a front part of the recording apparatus. The lid 3 can be removed or be pivoted in the direction A.

In FIGS. 2 to 6, the operation of the recording apparatus is shown. A separating roller 7 separates the recording sheets 6 one by one from a stack of the recording sheets 6 on the sheet-feeding cassette 4 and transfers the same to the recording unit. A carriage 8 is a head-carrying member capable of scanning across the recording sheet 6 in the width direction by being driven in a reciprocating movement by a driving source (not shown). A recording head 9 is detachably mounted on the carriage 8. The recording head 9 ejects ink onto the recording sheet 6, which has been transferred, in accordance with obtained image data, while the carriage 8 moves in a scanning motion, thereby recording images.

The recording apparatus also includes an intermediate roller 10, a driven roller 11 pressed to the intermediate roller 10 by being urged by a spring (not shown), a transfer roller 12, and a pinch roller 13 pressed to the transfer roller 12 by being urged by a spring (not shown). In the recording apparatus, a platen 14 guides rear surfaces of the recording sheets 6 in the recording unit, a sheet-discharging roller 15 discharges the recording sheets 6 after recording, and a spur 16 is pressed to the sheet discharging roller 15 by being urged by a spring (not shown). The spur 16 is a rotating member which has a small area that comes into contact with the recording sheet 6, whereby the spur 16 does not deteriorate ink images even when the spur 16 is brought into contact with the surface of the recording sheet 6 on which the ink images have been formed by ink ejection. A control board 17 controls the recording apparatus.

Figure 2:
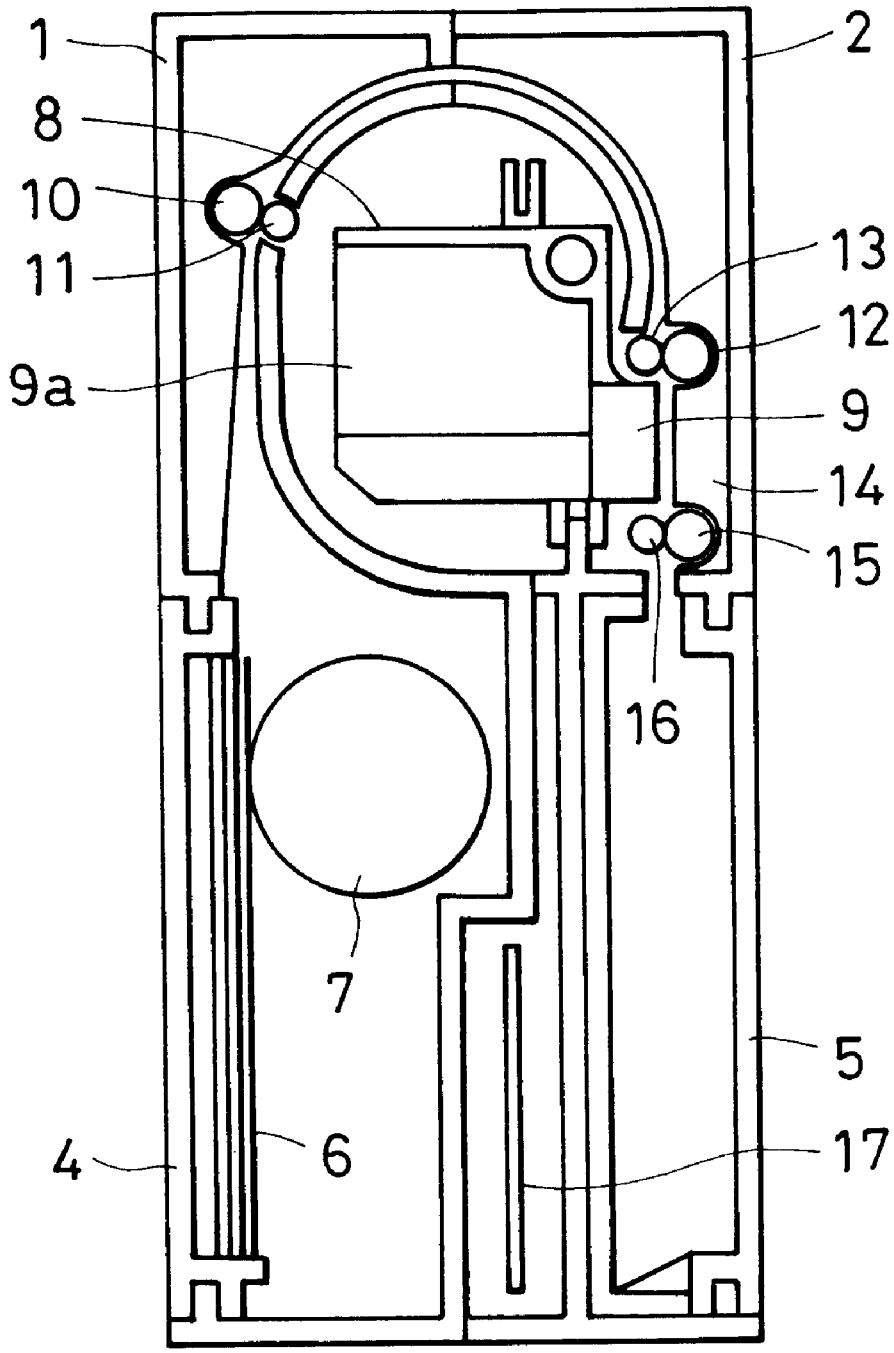
FIG. 2 is a sectional view of the recording apparatus shown in FIG. 1 along line 2(3-6)—2(3-6), showing the operation thereof.

In FIG. 2, the user loads the recording sheets 6 into the sheet-feeding cassette 4, which is capable of being removed from the first main-body case 1 in the direction A in FIG. 1, and mounts the sheet-feeding cassette 4 to the recording apparatus. The sheet-feeding cassette 4 may be partially drawn out from the recording apparatus and be loaded with the recording sheets 6 while the sheet-feeding cassette 4 is held by the recording apparatus, or the recording sheets 6 may be loaded in the sheet-feeding cassette 4 when the sheet-feeding cassette 4 is completely separated from the recording apparatus. The sheet-feeding cassette 4 loaded with the recording sheets 6 is mounted to the recording apparatus at the front part of the recording apparatus.

Figure 3:
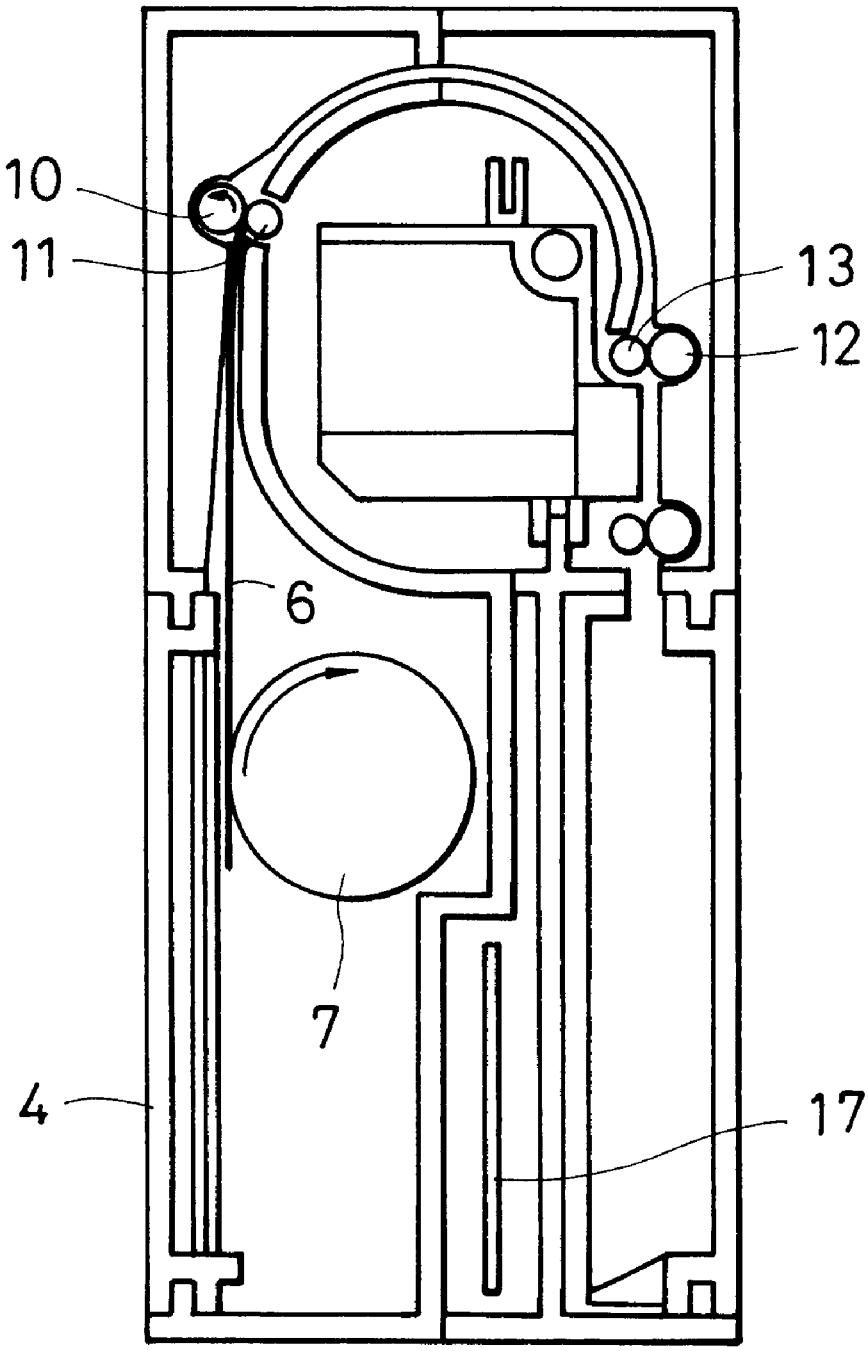
FIG. 3 is a sectional view of the recording apparatus shown in FIG. 1 along line 2(3-6)—2(3-6), showing the operation thereof.

In FIG. 3, when the control board 17 outputs a recording command, the separating roller 7 rotates in a direction of the arrow shown in the drawing, separates an uppermost sheet from the stack of the recording sheets 6 on the sheet-feeding cassette 4, and transfers the sheet to a nipping position of the intermediate roller 10 and the driven roller 11.

Figure 4:
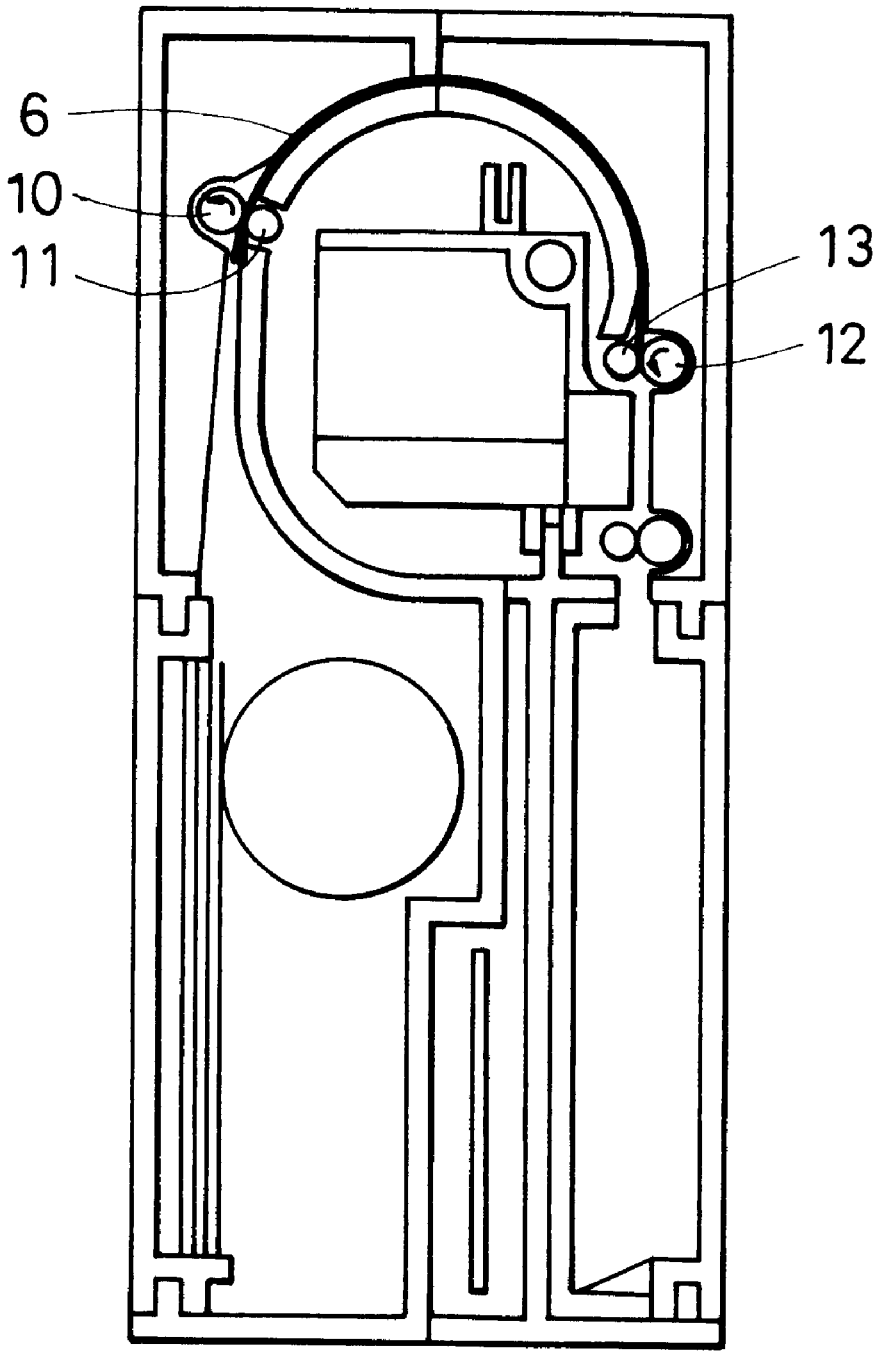
FIG. 4 is a sectional view of the recording apparatus shown in FIG. 1 along line 2(3-6)—2(3-6), showing the operation thereof.

In FIG. 4, the recording sheet 6 nipped by the intermediate roller 10 and the driven roller 11 is transferred by being driven by the intermediate roller 10 to a nipping position of the transfer roller 12 and the pinch roller 13.

Figure 5:
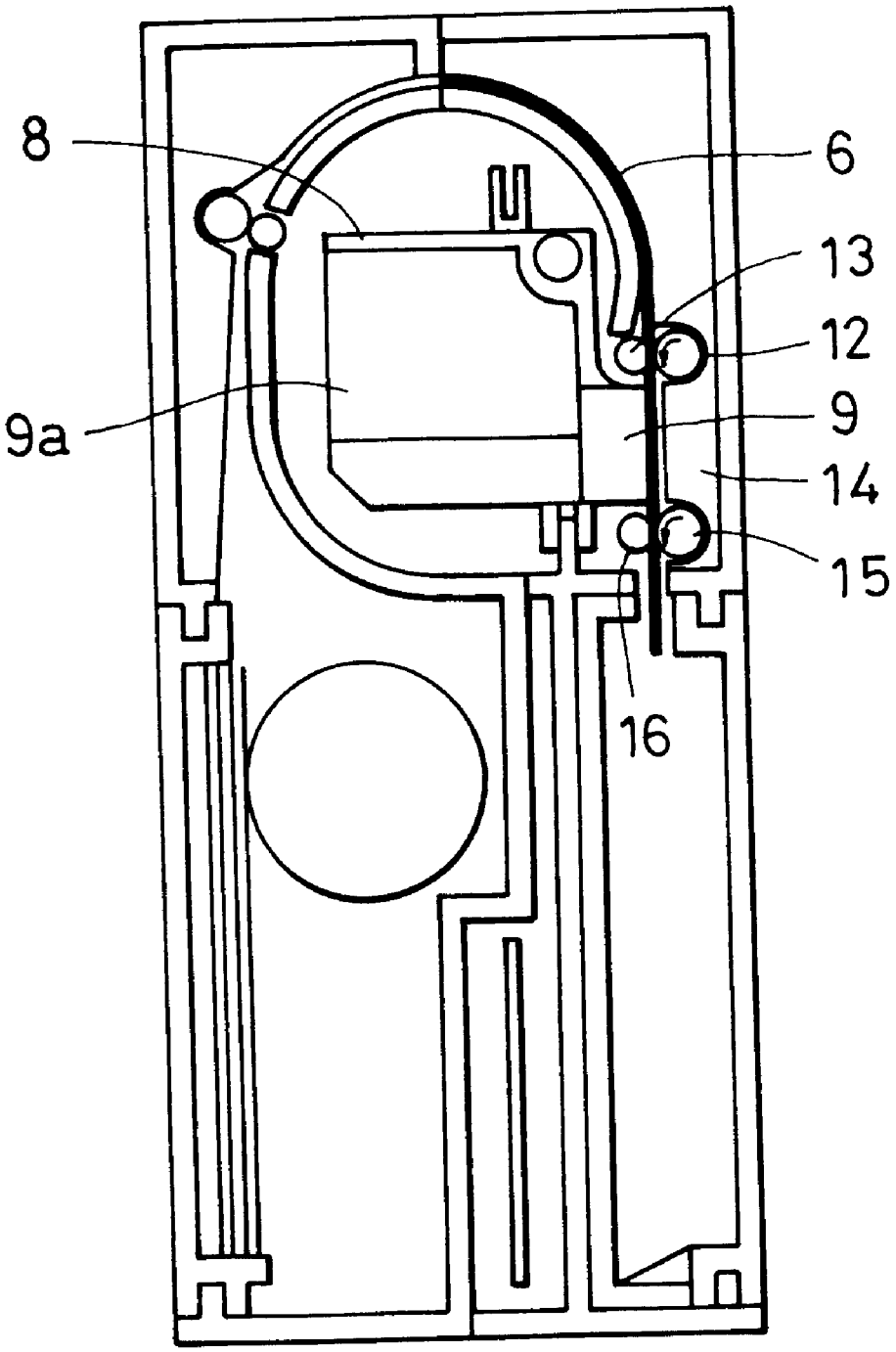
FIG. 5 is a sectional view of the recording apparatus shown in FIG. 1 along line 2(3-6)—2(3-6), showing the operation thereof.

In FIG. 5, the recording sheet 6 nipped by the transfer roller 12 and the pinch roller 13 is transferred to a space between the carriage 8 and the platen 14 by being driven by the transfer roller 12, and the recording head performs recording by ejecting ink in accordance with image data.

Figure 6:
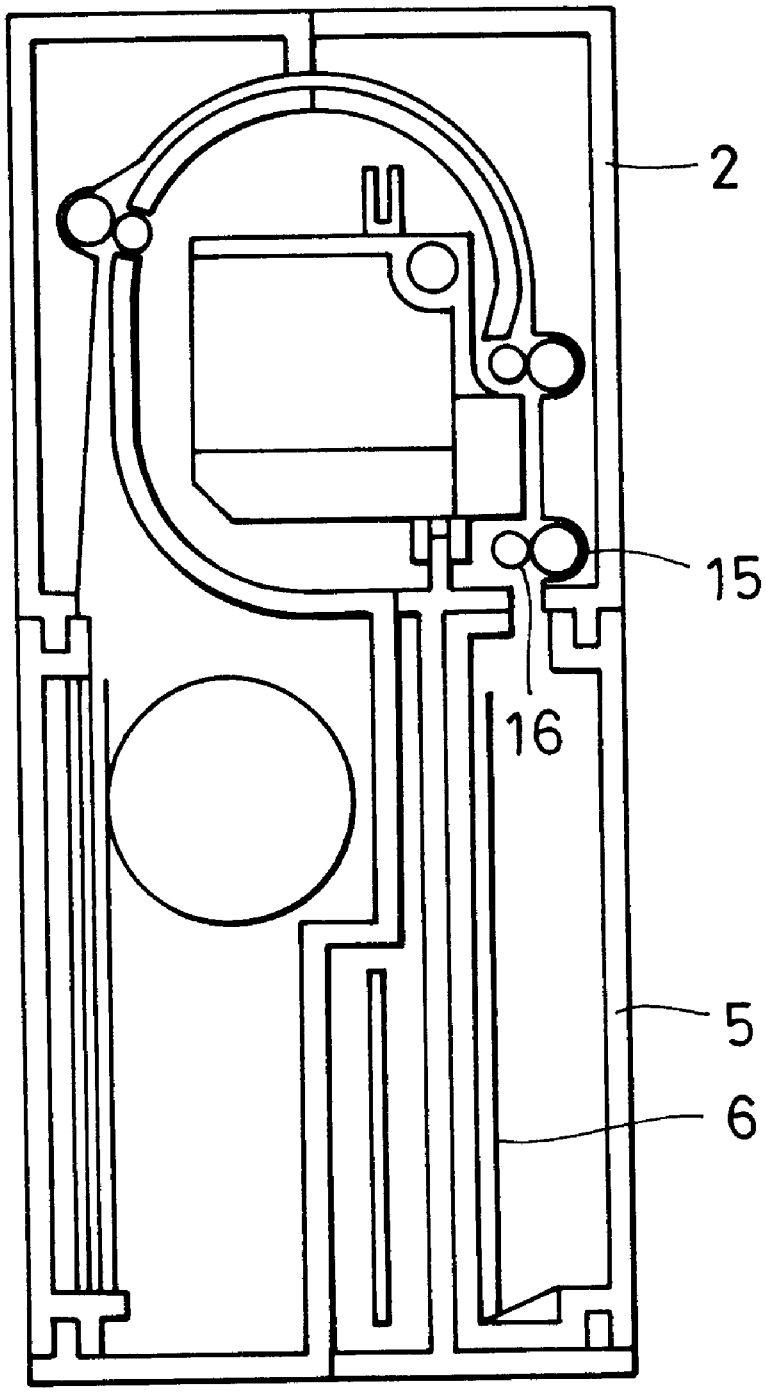
FIG. 6 is a sectional view of the recording apparatus shown in FIG. 1 along line 2(3-6)—2(3-6), showing the operation thereof.

In FIG. 6, the recording sheet 6 after recording is clamped by the sheet-discharging roller 15 and the spur 16, and is discharged into the sheet-discharging cassette 5 by being driven by the sheet-discharging roller 15. The user removes the sheet-discharging cassette 5 from the lower main-body case 2 in the direction A shown in FIG. 1, and unloads the recording sheets 6 after recording. The sheet discharging cassette 5 may be partially drawn out from the recording apparatus and the recorded recording sheets 6 unloaded while the sheet-discharging cassette 5 is held by the recording apparatus, or the recorded recording sheets 6 may be unloaded from the sheet-discharging cassette 5 when the sheet-discharging cassette 5 is completely separated from the recording apparatus. After the recorded recording sheets 6 are removed from the sheet-discharging cassette 5, the sheet discharging cassette 5 is mounted to the recording apparatus at the front part thereof.

With reference to FIGS. 7 and 8, an operation of mounting and detaching the recording head 9 on and from the carriage 8 is described below. When a problem is found in a recording operation of the recording head 9, the recording head 9 must be replaced. The user pivots the lid 3 in a direction B shown in FIG. 7, and slides the lid 3 in a direction C shown in FIG. 8. With this arrangement, space for pivoting the lid 3 above the recording apparatus is not required. When a sensor (not shown) determines that the lid 3 has been opened, the control board 17 moves the carriage 8 to a replacement position at the right of the recording apparatus, as shown in FIG. 8. An opening formed by pivoting the lid 3 serves as a mounting-and-detaching part. The user removes the recording head 9 from the carriage 8, disposed in the above-described position, in the direction A shown in FIG. 1, and mounts the replacing recording head 9 on the carriage 8. That is, the recording head 9 is mounted through the mounting-and-detaching part at the front part of the recording apparatus. Mounting and detaching of the recording head 9 may be performed by the user operating a member, such as a lever, or by the user directly handling the recording head 9. After the replacing recording head 9 is mounted, the lid 3 is returned to the position shown in FIG. 7, and the subsequent recording operation can be performed.

With the above-described arrangement, loading of the recording sheets 6 to be recorded to the sheet-feeding cassette 4, unloading of the recording sheets 6 after recording from the sheet-discharging cassette 5, and mounting and detaching of the recording head 9 to and from the carriage 8 through the mounting-and-detaching part can be individually performed at the front part of the recording apparatus, whereby a recording apparatus, which requires smaller space when being used, can be provided without impairing the function of the recording apparatus.

(Second Embodiment)

A second embodiment according to the present invention is described below with reference to FIG. 9. Although in the first embodiment, a serial-scan-type arrangement is applied to the recording apparatus in which a recording head mounted on a carriage serially scans in a direction crossing the direction of transfer of a recording sheet, a full-line type recording head is used in a recording apparatus according to the second embodiment, which can perform recording at one time on a portion over the width of the recording sheet.

Figure 9:
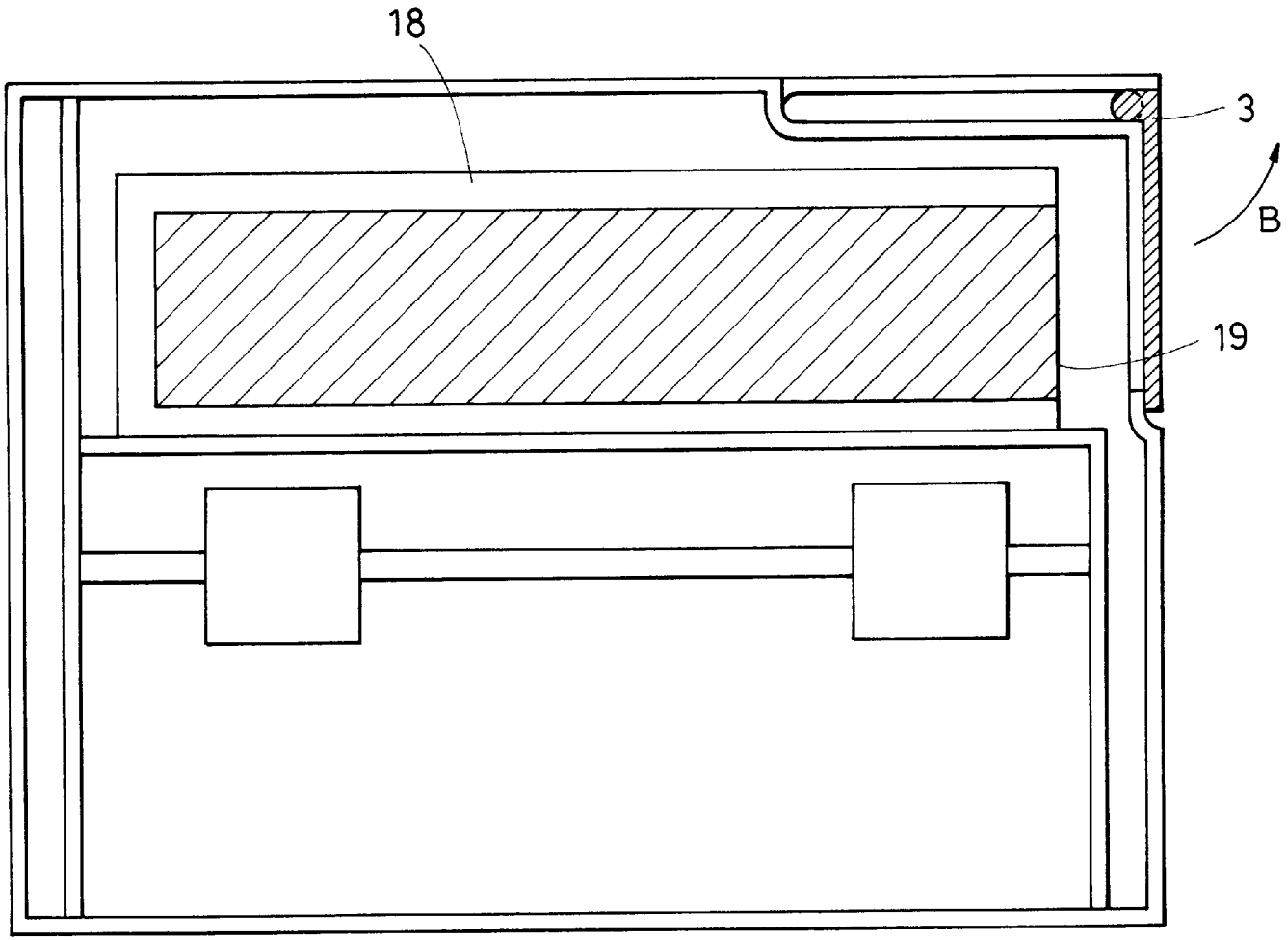
FIG. 9 is a sectional view of a recording apparatus according to a second embodiment.

In FIG. 9, a recording head 19 can record at one time on a portion over the width of a recording sheet, and the recording head 19 is detachably mounted on a head-carrying unit 18. When a problem in the recording operation of the recording head 19 occurs, the user pivots a lid 3 in the direction B shown in FIG. 7 and slides the lid 3 in a direction C as shown in FIG. 8. With this arrangement, space above the apparatus is not required for the pivoting motion of the lid 3. The recording head 19 is removed from the head-carrying unit 18 in the direction A shown in FIG. 1, and the replacing recording head 19 is mounted on the head-carrying unit 18. That is, the recording head 19 is mounted through a mounting-and-detaching part at a front part of the recording apparatus. Mounting and detaching of the recording head 19 may be performed either by the user operating a member, such as a lever, or by the user directly handling the recording head 19. After the replacing recording head 19 is mounted, the lid 3 is returned to the position shown in FIG. 7, and the subsequent recording operation can be performed.

The remaining configuration and operation of the recording apparatus according to the second embodiment are basically the same as those of the recording apparatus which is described in the first embodiment, and a detailed description thereof is omitted.

Figure 10:
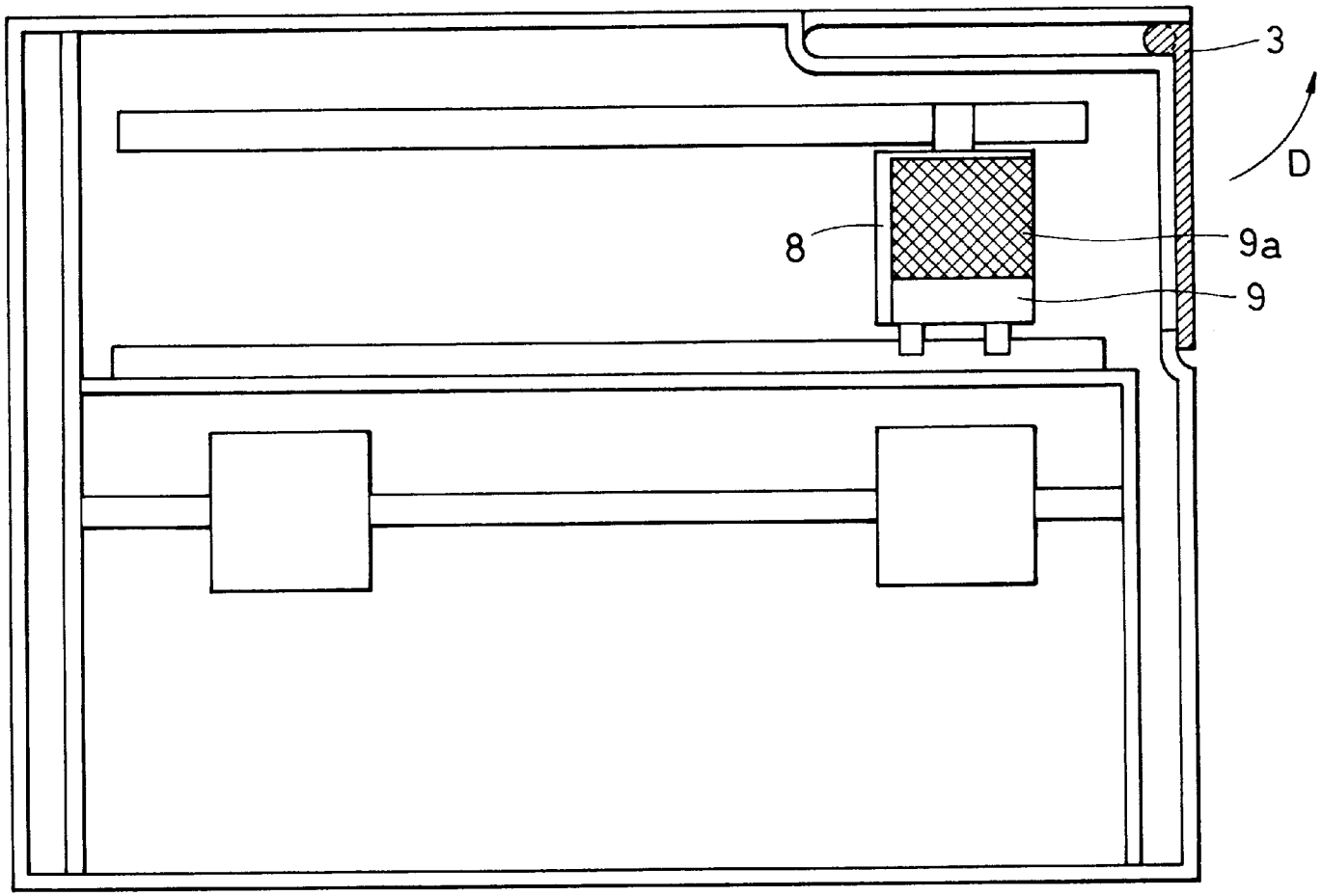
FIG. 10 is a sectional view of a recording apparatus according to a third embodiment.
Figure 11:
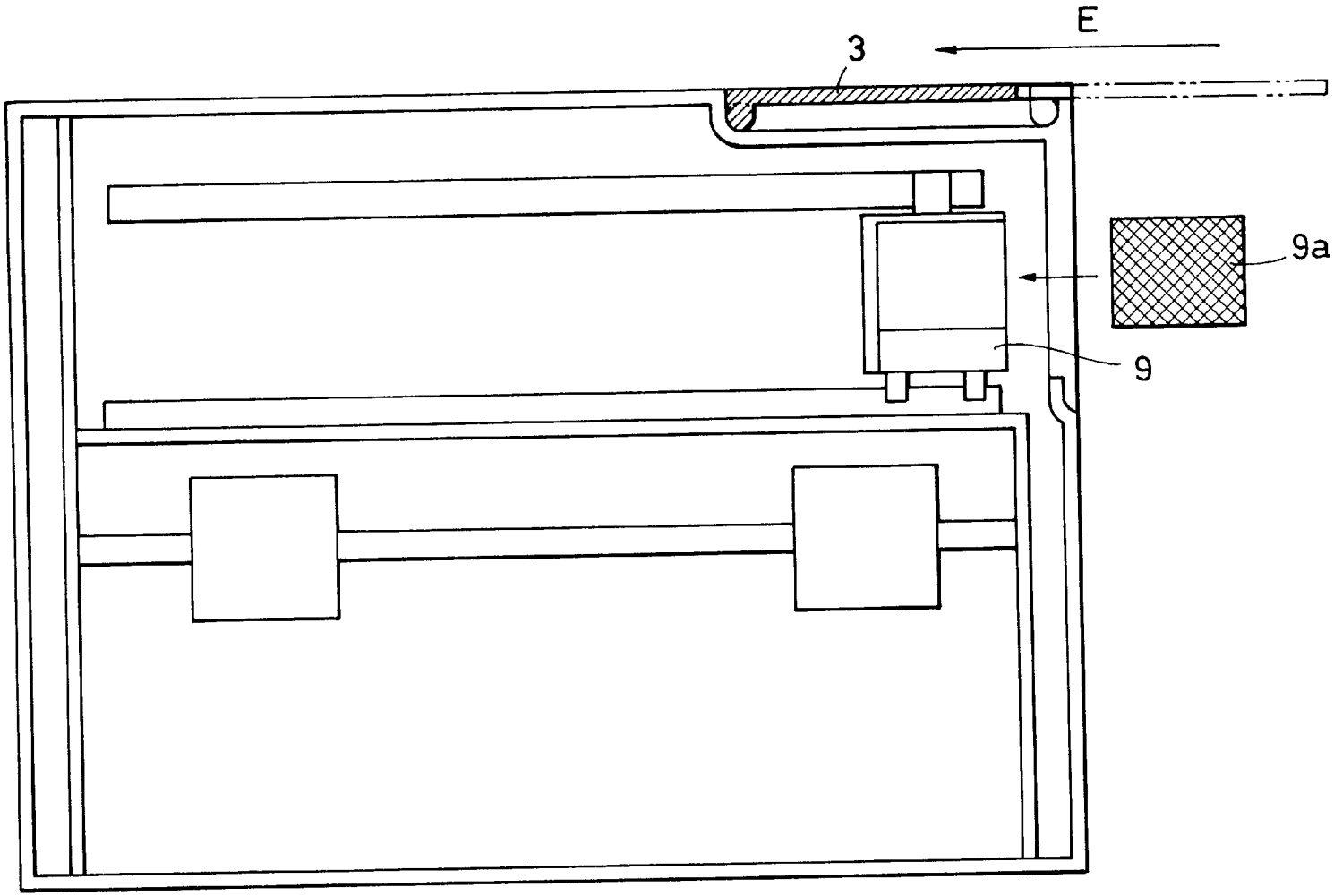
FIG. 11 is a sectional view of the recording apparatus according to the third embodiment.

A third embodiment is described below with reference to FIGS. 10 and 11. Although in the first embodiment, the recording head 9 is detachably mounted to the carriage 8, an ink tank 9*a* which supplies ink to the recording head 9 can be detachably mounted to the recording head 9, according to the third embodiment. The recording head 9 may be detachably mounted to the carriage 8 or be fixed to the carriage 8. The recording head 9 ejects ink onto a recording sheet 6, which has been transferred, in accordance with obtained image data, by the carriage 8 moving in a scanning motion, thereby recording images.

Mounting and detaching operations of the ink tank 9*a* to and from the recording head 9 are described below with reference to FIGS. 10 and 11. When a problem in the recording operation of the recording head 9 occurs or the ink in the ink tank 9*a* is used up, the ink tank 9*a* must be replaced. In this case, the user pivots a lid 3 in a direction D shown in FIG. 10 and slides the same in a direction E shown in FIG. 11. With this arrangement, space above the apparatus is not required for the pivoting motion of the lid 3. When a sensor (not shown) determines that the lid 3 is removed, control board 17 moves the carriage 8 to a replacement position at the right side of the apparatus, as shown in FIG. 11. An opening which is formed as the lid 3 is removed functions as a mounting-and-detaching part. The user removes the ink tank 9*a* from the recording head 9, disposed in the above-described position, in the direction A shown in FIG. 1, and mounts the replacing ink tank 9*a* to the recording head 9. That is, the ink tank 9*a* is mounted through the mounting-and-detaching part at the front part of the recording apparatus. Mounting and detaching of the ink tank 9*a* to and from the recording head 9 may be performed either by the user operating a member, such as a lever, or by the user directly handling the ink tank 9*a*. After the replacing ink tank 9*a* is mounted, the lid 3 is returned to the position shown in FIG. 10, and the subsequent recording operation can be performed.

With the above-described arrangement, loading of the recording sheets 6 to be recorded into a sheet-feeding cassette, unloading of the recording sheets 6 after recording from a sheet-discharging cassette, and mounting and detaching of the ink tank 9*a* to and from the recording head 9 through the mounting-and-detaching part can be individually performed at the front part of the recording apparatus, whereby a recording apparatus, which requires smaller space when being used, can be provided without impairing the function of the recording apparatus.

The present invention is not limited to the embodiments described above. Although in the above embodiments a sheet-feeding cassette and a sheet-discharging cassette are provided, a simple opening may be provided, through which recording sheets can be loaded and the recording sheets after recording can be unloaded. The opening may be covered.

Although the lid 3 is provided for replacing the recording head and the ink tank, any other method may be used.

The recording apparatus according to the present invention uses an ink-jet recording head which is provided with a unit for producing thermal energy for ejecting ink, such as an electric heat transfer unit or a laser, and in which a change in state of ink is caused by the thermal energy. The ink-jet recording head achieves superior effects in the recording apparatus because recording at high density and fineness is possible.

Regarding the typical configuration and principle of the ink-jet recording head, a basic principle disclosed in, for example, U.S. Pat. Nos. 4,723,129 and 4,740,796 is preferably used. The principle can be applied to an on-demand-type recording head and a continuous-type recording head. In particular, the principle is advantageous when applied to the on-demand-type recording head because the thermal energy is produced by an electric heat transfer unit and film boiling is generated at a thermal-acted surface of the recording head by applying at least one driving signal to the electric heat transfer unit disposed associated with a sheet and a liquid path containing liquid (ink or process liquid) so as to quickly raise temperature to exceed a nucleate boiling point in accordance with information data, whereby an air bubble can be produced in the liquid (ink or process liquid) in accordance with each driving signal. The liquid (ink or process liquid) is ejected by the development and contraction of the air bubble through an ejection nozzle, thereby forming at least one droplet of the liquid. The driving signal is preferably formed as a pulse because the development and contraction of the air bubble can be thereby performed more quickly and properly and the liquid (ink or process liquid) can be ejected with superior response. A pulsed driving signal which is disclosed in, for example, U.S. Pat. Nos. 4,463,359 and 4,345,262 may be suitable. Superior recording may be performed when the conditions concerning a rate of temperature rise on a thermal-acted surface, which are disclosed in, for example, U.S. Pat. No. 4,313,124, are applied.

The recording head according to the present invention may have a configuration in which a thermally active unit is disposed in a curved region, the thermally active unit being disclosed in, for example, U.S. Pat. Nos. 4,558,333 and 4,459,600, other than the configuration in which ejection nozzles, liquid paths, and electric heat transfer units (linear liquid paths or right-angled liquid paths) are disposed, as disclosed in, for example, the above-described patents. The present invention may offer an advantage with an arrangement in which a slit serves as an ejection unit common to a plurality of electric heat transfer units, as disclosed in, for example, Japanese Patent Application Laid-Open No. 59-123670, and with the arrangement in which an opening for absorbing liquid pressurized by thermal energy is formed associated with an ejection nozzle, as disclosed in, for example, Japanese Patent Application Laid-Open No. 59-138461. Recording may be reliably and efficiently performed, according to the present invention, by using any type of recording head.

The recording head may be a full-line-type recording head which has a length corresponding to a maximum width of a recording sheet on which the recording apparatus can record. This type of recording head may have a configuration in which a plurality of recording heads of which the sum of the lengths equals the required length or the plurality of recording heads are integrally formed as one recording head unit.

The recording head may be a serial-type recording head arranged so as to include a recording head fixed to a main body of the apparatus, a replaceable chip-type recording head, which, by being mounted to the apparatus, can be electrically connected to the apparatus and be supplied with ink from the apparatus, or a cartridge-type recording head integrally provided with an ink tank.

An ejection-recovery unit, an auxiliary unit, and the like are preferably added to the recording apparatus according to the present invention, since with this arrangement, the effect of the invention can be more stably obtained. The units which are preferably added to the recording head are, for example, a capping unit, a cleaning unit, a suction or pressurizing unit, an auxiliary heating unit for heating by using an electric heat transfer unit or other heating unit or a combination of both, and an auxiliary ejection-unit for performing ejection other than for recording.

One recording head may be provided so as to correspond to one ink, or a plurality of the recording heads may be provided so as to correspond to a plurality of inks having different colors and tones. That is, the recording apparatus according to the present invention may include at least one of the arrangements in which a recording mode by using one major color, such as black, is provided, and in which a recording mode, by using a plurality of inks having different colors or full-colored links to be formed with mixtures of colored inks, is provided.

Although liquid ink is used in the above embodiments, a type of ink, which is in a solid state at a temperature not higher than room temperature and softens or becomes liquid at room temperature, may be used. A type of ink, which is liquefied when a record-commanding signal is outputted, may be used, as the temperature of the ink for an ink-jet recording head is generally controlled so that the viscosity of the ink is in the range of stable-ejection at a temperature of 30° C. to 70° C. A type of ink, which is solid in a free state and becomes liquid by being heated, may be used, so that temperature rise in the ink due to thermal energy is avoided by positively using the temperature rise due to the thermal energy as energy for changing the state of the ink from a solid state to a liquid state, and evaporation of the ink is avoided. A type of ink which is liquefied when thermal energy is applied may be used, the ink being such as that which is liquefied by thermal energy being applied in response to a recording signal and is ejected in a liquid state, or that which has started to become solid when the ink reaches a recording medium. This type of ink is disclosed in, for example, Japanese Patent Application Laid-Open Nos. 54-56847 and 60-71260, in which the ink is maintained in a liquid or solid state in concavities and through-holes of a porous sheet which is disposed opposing an electric heat transfer unit. The most effective ink among the above-described inks, according to the present invention, may be one which is made active by film boiling.

The ink-jet recording apparatus according to the present invention may be applied to a copy machine including a reader, a facsimile machine having transmission and reception functions, and the like in addition to an image outputting terminal of an information processing unit, such as a computer.

According to the present embodiments, mounting of the recording sheets to the sheet-feeding cassette, removal of the recording sheets after recording from the sheet discharging cassette, and mounting and detaching of the recording head to and from the head-carrying member can be performed at a front part of the recording apparatus, whereby a recording apparatus is made possible, of which space, required when the recording apparatus is used, is reduced without impairing the function of the recording apparatus.

The recording head is mounted through the mounting-and-detaching part in a direction which is the same as the direction in which the sheet-feeding cassette and the sheet discharging cassette are respectively mounted to the recording apparatus, and which crosses the direction of transfer of the recording sheets, whereby a recording apparatus is made possible, of which space, required when the recording apparatus is used, is reduced without impairing the function of the recording apparatus.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus comprising:

head-carrying means for carrying a recording head which records on recording media;

first holding means for holding the recording media to be recorded, the recording media being loaded into the first holding means at a front part of the recording apparatus;

second holding means for holding recording media after recording, the recording media after recording being unloaded from the second holding means at the front part of the recording apparatus;

a mounting-and-detaching part for mounting and detaching the recording head to and from the head-carrying means, the recording head being mounted and detached to and from the head-carrying means at the front part of the recording apparatus through the mounting-and-detaching part, such that the recording head is mounted to and detached from the head-carrying means by substantially horizontal movement of the recording head; and a lid for covering the mounting-and-detaching part, wherein the lid is opened by rotation and sliding in the direction in which the recording head is mounted on the head-carrying means.

2. A recording apparatus according to claim 1, wherein at least one of the first holding means and the second holding means is covered with a second lid.

3. A recording apparatus according to claim 2, further comprising a main body case, wherein, in any position, the second lid does not extend beyond an outer perimeter defined by the peripheral edges of the front part of the main body case.

4. A recording apparatus according to claim 1, wherein the head-carrying means moves to a replacement position when the lid is open.

5. A recording apparatus according to claim 1, wherein at least one of the first holding means and the second holding means is provided with a cassette.

6. A recording apparatus according to claim 1, wherein the recording head includes an ink-jet recording head for recording images by ejecting ink.

7. A recording apparatus according to claim 6, wherein the ink-jet recording head records the images with ink droplets formed by thermal energy.

8. A recording apparatus according to claim 1, further comprising a main body case, wherein, in any position, the lid does not extend beyond an outer perimeter defined by the peripheral edges of the front part of the main body case.

9. A recording apparatus comprising:

head-carrying means for carrying a recording head which records on recording media;

transfer means for transferring the recording media;

holding means for holding the recording media to be recorded, the holding means being mounted to the recording apparatus in a direction crossing the direction in which the recording media are transferred;

a mounting-and-detaching part for mounting and detaching the recording head to and from the head-carrying means, the recording head being mounted through the mounting-and-detaching part in a direction which is the same as the direction in which the holding means is mounted to the recording apparatus and which crosses the direction in which the recording media are transferred, such that the recording head is mounted to and detached from the head-carrying means by substantially horizontal movement of the recording head; and a lid for covering the mounting-and-detaching part, wherein the lid is opened by rotation and sliding in the direction in which the recording head is mounted on the head-carrying means.

10. A recording apparatus according to claim 9, wherein the holding means is covered with a second lid.

11. A recording apparatus according to claim 10, further comprising a main body case, wherein, in any position, the second lid does not extend beyond an outer perimeter defined by the peripheral edges of the front part of the main body case.

12. A recording apparatus according to claim 9, wherein the head-carrying means moves to a replacement position when the lid is open.

13. A recording apparatus according to claim 9, wherein the holding means is provided with a cassette.

14. A recording apparatus according to claim 9, wherein the recording head includes an ink-jet recording head for recording images by ejecting ink.

15. A recording apparatus according to claim 14, wherein the ink-jet recording head records the images with ink droplets formed by thermal energy.

16. A recording apparatus according to claim 9, further comprising a main body case, wherein, in any position, the lid does not extend beyond an outer perimeter defined by the peripheral edges of the front part of the main body case.

17. A recording apparatus comprising:

head-carrying means for carrying a recording head which records on recording media;

transfer means for transferring the recording media;

holding means for holding the recording media after recording, the holding means being mounted to the recording apparatus in a direction crossing the direction in which the recording media are transferred;

a mounting-and-detaching part for mounting and detaching the recording head to and from the head-carrying means, the recording head being mounted through the mounting-and-detaching part in a direction which is the same as the direction in which the holding means is mounted to the recording apparatus and which crosses the direction in which the recording media are transferred, such that the recording head is mounted to and detached from the head-carrying means by substantially horizontal movement of the recording head; and a lid for covering the mounting-and-detaching part, wherein the lid is opened by rotation and sliding in the direction in which the recording head is mounted on the head-carrying means.

18. A recording apparatus according to claim 17, wherein the holding means is covered with a second lid.

19. A recording apparatus according to claim 18, further comprising a main body case, wherein, in any position, the second lid does not extend beyond an outer perimeter defined by the peripheral edges of the front part of the main body case.

20. A recording apparatus according to claim 17, wherein the head-carrying means moves to a replacement position when the lid is open.

21. A recording apparatus according to claim 17, wherein the holding means is provided with a cassette.

22. A recording apparatus according to claim 17, wherein the recording head includes an ink-jet recording head for recording images by ejecting ink.

23. A recording apparatus according to claim 22, wherein the ink-jet recording head records the images with ink droplets formed by thermal energy.

24. A recording apparatus according to claim 17, further comprising a main body case, wherein, in any position, the lid does not extend beyond an outer perimeter defined by the peripheral edges of the front part of the main body case.

25. A recording apparatus comprising:

head-carrying means for carrying a recording head which records on recording media;

transfer means for transferring the recording media;

first holding means for holding the recording media to be recorded, the first holding means being mounted to the recording apparatus in a direction crossing the direction in which the recording media are transferred;

second holding means for holding the recording media after recording, the second holding means being mounted to the recording apparatus in a direction which is the same as the direction in which the first holding means is mounted to the recording apparatus and which crosses the direction in which the recording media are transferred;

a mounting-and-detaching part for mounting and detaching the recording head to and from the head-carrying means, the recording head being mounted through the mounting-and-detaching part in a direction which is the same as the direction in which the first holding means is mounted to the recording apparatus and which crosses the direction in which the recording media are transferred, such that the recording head is mounted to and detached from the head-carrying means by substantially horizontal movement of the recording head; and a lid for covering the mounting-and-detaching part, wherein the lid is opened by rotation and sliding in the direction in which the recording head is mounted on the head-carrying means.

26. A recording apparatus according to claim 25, wherein at least one of the first holding means and the second holding means is covered with a second lid.

27. A recording apparatus according to claim 26, further comprising a main body case, wherein, in any position, the second lid does not extend beyond an outer perimeter defined by the peripheral edges of the front part of the main body case.

28. A recording apparatus according to claim 25, wherein the head-carrying means moves to a replacement position when the lid is open.

29. A recording apparatus according to claim 25, wherein at least one of the first holding means and the second holding means is provided with a cassette.

30. A recording apparatus according to claim 25, wherein the recording head includes an ink-jet recording head for recording images by ejecting ink.

31. A recording apparatus according to claim 30, wherein the ink-jet recording head records the images with ink droplets formed by thermal energy.

32. A recording apparatus according to claim 25, further comprising a main body case, wherein, in any position, the lid does not extend beyond an outer perimeter defined by the peripheral edges of the front part of the main body case.

* * * * *